US010633717B2

(12) United States Patent
Uehara et al.

(10) Patent No.: US 10,633,717 B2
(45) Date of Patent: Apr. 28, 2020

(54) LOW THERMAL EXPANSION SUPERALLOY AND MANUFACTURING METHOD THEREOF

(71) Applicant: HITACHI METALS, LTD., Tokyo (JP)

(72) Inventors: Toshihiro Uehara, Yasugi (JP); Naoya Sato, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 266 days.

(21) Appl. No.: 15/763,617

(22) PCT Filed: Jul. 29, 2016

(86) PCT No.: PCT/JP2016/072260

§ 371 (c)(1),
(2) Date: Mar. 27, 2018

(87) PCT Pub. No.: WO2017/056674

PCT Pub. Date: Apr. 6, 2017

(65) Prior Publication Data

US 2019/0048433 A1 Feb. 14, 2019

(30) Foreign Application Priority Data

Sep. 29, 2015 (JP) ..... 2015-191752

(51) Int. Cl.

| | |
|---|---|
| ***C21D 6/00*** | (2006.01) |
| ***C22B 9/04*** | (2006.01) |
| ***C22C 38/14*** | (2006.01) |
| ***C22C 38/02*** | (2006.01) |
| ***C22C 38/12*** | (2006.01) |
| ***F01D 25/26*** | (2006.01) |
| ***F01D 5/28*** | (2006.01) |
| ***C21D 6/02*** | (2006.01) |
| ***F01D 25/00*** | (2006.01) |
| ***C21D 8/02*** | (2006.01) |
| ***C22C 38/00*** | (2006.01) |
| ***C22C 38/04*** | (2006.01) |
| ***C22C 38/10*** | (2006.01) |
| ***C22C 30/00*** | (2006.01) |

(52) U.S. Cl.

CPC ..... *C21D 6/001* (2013.01); *C21D 6/005* (2013.01); *C21D 6/007* (2013.01); *C21D 6/008* (2013.01); *C21D 6/02* (2013.01); *C21D 8/0226* (2013.01); *C21D 8/0231* (2013.01); *C22B 9/04* (2013.01); *C22C 38/002* (2013.01); *C22C 38/02* (2013.01); *C22C 38/04* (2013.01); *C22C 38/105* (2013.01); *C22C 38/12* (2013.01); *C22C 38/14* (2013.01); *F01D 5/28* (2013.01); *F01D 25/005* (2013.01); *F01D 25/26* (2013.01); *C21D 2211/001* (2013.01); *C21D 2211/004* (2013.01); *C22C 30/00* (2013.01); *F05D 2300/175* (2013.01); *F05D 2300/5021* (2013.01)

(58) Field of Classification Search

CPC ..... C22B 9/04; C22C 30/00; C22C 38/002; C22C 38/004; C22C 38/02; C22C 38/04; C22C 38/06; C22C 38/105; C22C 38/12; C22C 38/14; C21D 6/001; C21D 6/005; C21D 6/007; C21D 6/008; C21D 6/02; C21D 8/0226; C21D 8/0247

See application file for complete search history.

(56) References Cited

U.S. PATENT DOCUMENTS

| | | | | |
|---|---|---|---|---|
| 3,865,581 A | | 2/1975 | Sekino et al. | |
| 4,066,447 A | | 1/1978 | Smith, Jr. et al. | |
| 4,200,459 A | * | 4/1980 | Smith, Jr. | C22C 38/105 420/447 |
| 5,192,497 A | * | 3/1993 | Sato | C22C 30/00 420/581 |
| 10,233,523 B2 | * | 3/2019 | Nishiyama | C22C 30/02 |

FOREIGN PATENT DOCUMENTS

| | | |
|---|---|---|
| EP | 0 104 738 | 4/1984 |
| EP | 0 558 775 | 8/1993 |
| GB | 997767 | 7/1965 |
| GB | 1 524 800 | 9/1978 |
| JP | 41-2767 | 10/1962 |
| JP | 48-79120 | 10/1973 |
| JP | 53-6225 | 1/1978 |
| JP | 59-56563 | 4/1984 |
| JP | 61-231138 | 10/1986 |

(Continued)

OTHER PUBLICATIONS

RU 2125110 C1 machine translation of the description (Year: 1999).*

International Search Report, dated Sep. 27, 2016 in corresponding International Patent Application No. PCT/JP2016/072260.

*Primary Examiner* — Tima M. McGuthry-Banks

(74) *Attorney, Agent, or Firm* — Wenderoth, Lind & Ponack, L.L.P.

(57) ABSTRACT

A low thermal expansion superalloy is composed of, in mass %, 0.1% or less of C, 0.1-1.0% of Si, 1.0% or less of Mn, 25-32% of Ni, more than 18% but less than 24% of Co, more than 0.25% but 1.0% or less of Al, 0.5-1.5% of Ti, more than 2.1% but less than 3.0% of Nb, 0.001-0.01% of B and 0.0005-0.01% of Mg, with the balance of Fe and unavoidable impurities, while satisfying Mg/S≥1, 52.9≤1.235Ni+Co<55.8%, (Al+Ti+Nb) is 3.5-5.5%, and the F value is 8% or less. In the superalloy, a granular intermetallic compound containing Si, Nb, and Ni alone or in a total amount of 36 mass % or more is precipitated at a grain boundary of an austenite matrix, and an intermetallic compound including a larger concentration of Ni, Al, Ti, and Nb and having 50 nm or smaller of an average diameter is precipitated in the austenite matrix.

8 Claims, No Drawings

(56) References Cited

FOREIGN PATENT DOCUMENTS

| | | |
|---|---|---|
| JP | 4-218642 | 8/1992 |
| JP | 6-228714 | 8/1994 |
| JP | 2001-214246 | 8/2001 |
| JP | 2001-234292 | 8/2001 |
| RU | 2125110 C1 * | 1/1999 |

* cited by examiner

LOW THERMAL EXPANSION SUPERALLOY AND MANUFACTURING METHOD THEREOF

TECHNICAL FIELD

The present invention relates to a high strength low thermal expansion superalloy having resistance to oxidation suitable for a large member used at high temperature such as a thermal power plant or the like and a manufacturing method thereof.

BACKGROUND ART

As a low thermal expansion Fe-based alloy, Fe—Ni-based and Fe—Ni—Co-based alloys such as Fe-36% Ni-based, Fe-42% Ni-based, Fe-29% Ni-17% Co-based alloys are well known. These alloys exhibit an extremely low thermal expansion coefficient near room temperature due to Invar effect. In addition, low thermal expansion alloys having high strength are disclosed in JP-B-S41-2767 (PTL 1), JP-A-S59-56563 (PTL 2), and JP-A-H04-218642 (PTL 3). In these alloys, it is possible to obtain high strength and a relatively low thermal expansion coefficient not only at room temperature but also at a certain degree of high temperature. In addition, low thermal expansion alloys having high strength of which oxidation resistance is improved at high temperature are disclosed in JP-A-S53-6225 (PTL 4), JP-A-2001-234292 (PTL 5).

CITATION LIST

Patent Literature

[PTL 1] JP-A-S41-2767
[PTL 2] JP-A-S59-56563
[PTL 3] JP-A-H04-218642
[PTL 4] JP-A-S53-6225
[PTL 5] JP-A-2001-234292

SUMMARY OF INVENTION

Technical Problem

Fe—Ni-based and Fe—Ni—Co-based alloys such as Fe-36% Ni-based, Fe-42% Ni-based, Fe-29% Ni-17% Co-based alloys exhibit low strength at room temperature and high temperature, and are difficult to be applied to a use requiring high strength. In addition, since the alloys do not include elements such as Cr, Al, and Ti that contribute to improvement in oxidation resistance, oxidation is likely to occur at high temperature and it is not suitable for use at high temperature.

The alloy disclosed in PTL 1 is a low thermal expansion alloy having high strength, but has problems that notch sensitivity is high at a temperature in the vicinity of 500° C. to 650° C. and there is a large difference between notch creep rupture strength and smooth creep rupture strength at high temperature.

The alloy disclosed in PTL 2 has favorable notch creep rupture strength comparing to the alloy disclosed in PTL 1, but has a thermal expansion coefficient slightly larger than that of the alloy of PTL 1. Therefore, from a viewpoint of a low thermal expansion, it was not necessarily sufficient.

The alloy disclosed in PTL 3 has notch creep rupture strength more favorable than that of the alloy disclosed in PTL 1 and has a thermal expansion coefficient lower than that of the alloys disclosed in PTLs 1 and 2. Therefore, the alloy disclosed in PTL 3 is an alloy which has favorable balance of characteristics such as high strength and low thermal expansion. However, since the alloys disclosed in PTLs 1, 2, and 3 do not include an element such as Cr that contributes to improvement in oxidation resistance, oxidation is likely to occur at high temperature and there is a limit to the use in an oxidizing environment, for example, in the air at high temperature.

The alloys disclosed in PTLs 4 and 5 are alloys that have high strength and are made in consideration of use in high temperature oxidizing atmosphere by improving oxidation resistance by adding Cr. However, since an addition amount of Cr is large, a thermal expansion coefficient is large in the low thermal expansion alloys, and the alloys disclosed in PTLs 4 and 5 are not sufficient comparing to the alloys disclosed in PTLs 1, 2, and 3 from a viewpoint of thermal expansion coefficient.

In recent years, in order to improve efficiency of thermal power plants such as a gas turbine and to reduce an amount of carbon dioxide emission, an operating temperature becomes higher and a size of a turbine becomes larger. Accordingly, larger parts are required more than in the related art. Since it is still required to reduce a size of various parts or clearance between the parts more than the related art and a way of reducing the clearance is desirable, there is a great need for a low thermal expansion alloy. In this circumstance, a need for large parts made of low thermal expansion alloys has increased. It is known that, in superalloy including a lot of additive elements, macrosegregation defects are likely to occur during solidification. The low thermal expansion superalloys disclosed in PTLs 1 to 5 also show the same tendency. Therefore, in a case where a large ingot is melted and cast in order to manufacture a large part, there is possibility that a freckle defect that is one of the macrosegregation defects occurs and an increase in size has been restricted.

An object of the present invention is to provide a low thermal expansion superalloy which has high strength, favorable notch creep rupture strength, a low thermal expansion coefficient, and oxidation resistance at an operating temperature and with which a large part can be manufactured, and a manufacturing method thereof.

Solution to Problem

The present inventors have conducted intensive studies on an Fe—Ni—Co-based alloy including Al, Ti, and Nb, in order to solve such problems. As a result, a proportion of Fe, Ni, and Co at which a low thermal expansion can be obtained; appropriate ranges of Al, Ti, and Nb in which high strength is obtained at room temperature and high temperature; appropriate ranges of an addition of Si alone and Si and Cr to maintain the low thermal expansion and improve oxidation resistance of grain boundaries, an addition of Mg to improve hot workability, and a ratio between Mg and S; and optimal balance in whole composition to suppress a macrosegregation during solidification of a large ingot were found. Moreover, it was found that, in order to obtain favorable balance of characteristics, it is effective to cause discontinuous precipitation of an intermetallic compound including Si, Nb, and Ni at grain boundaries of an austenite matrix and form a structure having a fine intermetallic compound including a large amount of Ni, Al, Ti, and Nb in the austenite matrix, and the present invention has been completed.

In addition, it was found that, in order to stably satisfy the favorable low thermal expansion characteristic and mechanical properties, it is effective to perform a solution treatment and an aging treatment at a relatively low temperature, and the present invention has been conceived.

That is, according to the present invention, there is provided a low thermal expansion superalloy including, in terms of mass %, 0.1% or less of C, 0.1% to 1.0% of Si, 1.0% or less of Mn, 25% to 32% of Ni, more than 18% and less than 24% of Co, more than 0.25% and 1.0% or less of Al, 0.5% to 1.5% of Ti, more than 2.1% and less than 3.0% of Nb, 0.001% to 0.01% of B, 0.0005% to 0.01% of Mg, a remainder of Fe, and inevitable impurities, in which relationships of $Mg/S \geq 1$, $52.9\% \leq 1.235Ni+Co < 55.8\%$, 3.5% or more and less than 5.5% of Al+Ti+Nb, and 8% or less of an absolute value of F value which is calculated based on F value=0.0014Ni+0.6Co−6.8Al+7.6Ti−5.3Nb−0.11Fe are satisfied, a granular intermetallic compound containing one or more elements of Si, Nb, and Ni alone or in a total amount of 36 mass % or more is precipitated at a grain boundary of an austenite matrix, and the low thermal expansion superalloy has a structure in which the intermetallic compound including a larger concentration of Ni, Al, Ti, and Nb than that of the alloy and having 50 nm or smaller of a diameter by an average value is precipitated in the austenite matrix.

The low thermal expansion superalloy preferably has a composition including, in terms of mass %, 0.05% or less of C, 0.2% to 0.7% of Si, 0.5% or less of Mn, 26% to 290% of Ni, more than 18% and 22% or less of Co, 0.3% to 0.6% of Al, 0.6% or more and less than 1.2% of Ti, 2.5% or more and less than 3.0% of Nb, 0.001% to 0.01% of B, 0.0005% to 0.01% of Mg, a remainder of Fe, and inevitable impurities, in which relationships of $Mg/S \geq 1$, $52.9\% \leq 1.235Ni+Co < 55.8\%$, 3.5% to 4.7% of Al+Ti+Nb, and 6% or less of the absolute value of the F value which is calculated based on F value=0.0014Ni+0.6Co−6.8Al+7.6Ti−5.3Nb−0.11Fe are satisfied.

The low thermal expansion superalloy desirably includes 0.1% or more and less than 1.7% of Cr in terms of mass %, and more desirably includes 0.4% to 1.6% of Cr in terms of mass %.

According to the low thermal expansion superalloy, reduction of area in a room temperature tensile test in a solution treated state can be set to 50% or higher.

In addition, the low thermal expansion superalloy has an average thermal expansion coefficient at 30° C. to 500° C. in an aging treated state is $8.1 \times 10^{-6}$/° C. or lower, tensile strength at room temperature is 780 MPa or higher, tensile strength at 550° C. is 600 MPa or higher, a parallel portion thereof ruptures in a combination smooth/notched creep test under a stress of 510 MPa at 650° C. and elongation after rupture is 10% or more, and in an oxidation test at 600° C. in the air for 100 hours, an oxide layer is not spalled and an oxidation weight gain can be set to 1.3 mg/cm$^2$ or less.

In addition, according to the present invention, there is provided a manufacturing method for a low thermal expansion superalloy having the above composition. The manufacturing method desirably includes: performing vacuum induction melting on the low thermal expansion superalloy to obtain an ingot; performing hot plastic working once or more by using the ingot; performing an solution treatment at 850° C. to 1080° C.; performing an aging treatment, at least once, including holding at 580° C. to 700° C. for 8 to 100 hours; causing precipitation of a granular intermetallic compound containing one or more elements of Si, Nb, and Ni alone or in a total amount of 36 mass % or more at a grain boundary of an austenite matrix; and causing precipitation of an intermetallic compound including a larger concentration of Ni, Al, Ti, and Nb than that of the alloy and having 50 nm or smaller of a diameter by an average value in the austenite matrix.

More preferably, it is desirable that, after the vacuum induction melting, electroslag remelting and/or vacuum arc remelting is performed to manufacture an ingot.

Advantageous Effects of Invention

In a case where the low thermal expansion superalloy according to the present invention is used for applications such as a large gas turbine part, a part joining with ceramics, glass, or the like, and a part joining with a cemented carbide, it is possible to maintain a clearance between parts to small in a range of room temperature to high temperature and it is possible to obtain a relatively favorable oxidation resistance and stable high strength, thereby achieving higher reliability.

DESCRIPTION OF EMBODIMENTS

First, each element specified in the present invention and a content thereof will be described. Note that unless otherwise specified, the content is expressed as mass %.

C reacts with Ti and Nb to form an MC type carbide, prevents a crystal grain from coarsening during forging or solution treating, and contributes to improvement of strength. However, in a case where C exceeds 0.1%, not only a large amount of carbides are formed and a chain-like carbide is unevenly distributed to form an uneven macrostructure, but also it is difficult to obtain sufficient strength because an amount of Ti and Nb required for forming a precipitation-hardening phase during the aging treatment is reduced. Therefore, C is set to 0.1% or less. Preferably, the C may be 0.05% or less. In order to ensure the effects due to C, a lower limit thereof may be set to 0.005%.

Since Si reacts with Fe and Nb to discontinuously generate a granular intermetallic compound containing one or more kinds of Si, Nb, and Ni in a total amount of 36 mass % or more at grain boundaries of austenite, Si is an element required for strengthening the grain boundary. In a case where Si is less than 0.1%, an amount of the intermetallic compound precipitated at the grain boundary is small, therefore Si is less likely to contribute to strengthening of the grain boundary. On the other hand, in a case where Si exceeds 1.0%, not only an excessively large amount of the intermetallic compound is generated at the grain boundary and in the grain to deteriorate the hot workability, but also ductility in a tensile test at room temperature and high temperature is deteriorated. Therefore, Si is set to 0.1% to 1.0%. Preferably, a lower limit of Si is 0.2%, and more preferably the lower limit of Si is 0.3%. In addition, preferably an upper limit of Si is 0.7%, and more preferably the upper limit of Si is 0.6%.

Mn is added as a deoxidizing agent and desulfurizing agent, but also forms a solid solution in the alloy. In a case where Mn exceeds 1.0%, the thermal expansion coefficient increases, therefore the Mn is set to 1.0% or less. Preferably, the Mn may be 0.5% or less, more preferably 0.3% or less, and still more preferably 0.2% or less.

Ni is a main element forming the austenite matrix along with Fe, Co, and Cr. In particular, since amounts and proportions of Fe, Ni, and Co greatly affect the thermal expansion coefficient, in order to obtain the low thermal expansion, it is necessary to appropriately control the amounts and proportions of Fe, Ni, and Co. In addition, Ni is an important element forming a γ' phase that is the precipitation-hardening phase, and is an element greatly affecting the strength. As above, since Ni stabilizes the austenite matrix and is also used to form the γ' phase that is the precipitation-hardening phase at the same time, the Ni is required in an amount necessary for forming both of the above. In a case where Ni is less than 25%, the austenite phase becomes unstable to easily generate martensite and the thermal expansion coefficient increases. On the other hand, in a case where Ni exceeds 32%, a Curie point rises and the thermal expansion coefficient increases over a wide temperature range from a low temperature to high temperature. Therefore, Ni is set to 25% to 32%. A lower limit of Ni is preferably 26% and an upper limit of Ni is preferably 29%.

Co is an element forming the austenite matrix along with Fe, Ni, and Cr. In particular, since amounts and proportions of Fe, Ni, and Co greatly affect the thermal expansion coefficient, in order to obtain the low thermal expansion, it is necessary to appropriately control the amounts and proportions of Fe, Ni, and Co. In a case where Co is 18% or less, the Curie point is lowered and the thermal expansion coefficient rapidly increases at high temperature. On the other hand, in a case where the Co is 24% or more, the Curie point rises and the thermal expansion coefficient increases over a wide temperature range of a low temperature to high temperature. Therefore, Co is set to more than 18% and less than 24%. An upper limit of Co content is preferably 22% or less.

As described above, a low thermal expansion coefficient can be obtained by appropriately controlling the amounts and the proportion of Ni and Co. Since Co contributes to lowering of thermal expansion coefficient by 1.235 times Ni, it is possible to control the amounts and the proportions of Ni and Co by appropriately controlling a value of 1.235Ni+Co. In a case where the value of 1.235Ni+Co is 55.80% or higher, the thermal expansion coefficient excessively increases. On the other hand, in a case where the value is lower than 52.9%, the martensite is easily formed and it is difficult to obtain a stable austenite structure. Therefore, the value is set to satisfy $52.9\% \leq 1.235Ni+Co < 55.8\%$. Note that, in the relational expression, each element symbol also represents a content of the element symbol as it is.

Al is an element forming γ' phase-($Ni_3(Al,Ti,Nb)$) that is the intermetallic compound finely precipitated in the austenite grain by aging treatment to increase strength at room temperature and high temperature, and is an essential element. In a case where Al is 0.25% or less, an effect to increase strength is small. On the other hand, in a case where Al exceeds 1.0%, the thermal expansion coefficient increases. Therefore, Al is set to more than 0.25% and 1.0% or less. A lower limit of Al is preferably 0.3% and an upper limit of Al is preferably 0.6%.

Ti is also an element forming γ' phase-($Ni_3(Al,Ti,Nb)$) that is the intermetallic compound finely precipitated in the austenite grain by aging treatment to increase strength at room temperature and high temperature, and is an essential element. In a case where Ti is less than 0.5%, an effect to increase strength is small. On the other hand, in a case where Ti exceeds 1.5%, the thermal expansion coefficient increases. Therefore, Ti is set to 0.5% to 1.5%. A lower limit of Ti is preferably 0.6% and an amount of Ti related to an upper limit is preferably less than 1.2%.

Nb is also an element forming γ' phase-($Ni_3(Al,Ti,Nb)$) that is the intermetallic compound finely precipitated in the austenite grain by aging treatment to increase strength at room temperature and high temperature, and is an essential element. In addition, Since Nb is a constituent element of a granular intermetallic compound precipitated at the grain boundary of austenite to increase strength of the grain boundary and having Ni, Si, and Nb as main constituent elements which improve high temperature strength, Nb is an essential element. In a case where Nb is 2.1% or less, an effect to improve strength is small. On the other hand, in a case where Nb is 3.0% or more, not only the thermal expansion coefficient increases but also a macrosegregation is promoted. Therefore, Nb is set to more than 2.1% and less than 3.00%. A lower limit of Nb is preferably 2.5% and an upper limit of Nb is preferably less than 3.0%.

Regarding Al, Ti, and Nb among the elements forming the γ' phase, the higher value of Al+Ti+Nb which is a total amount thereof, the higher strength at room temperature and high temperature. In a case where the value of Al+Ti+Nb is smaller than 3.5%, an amount of the precipitation of γ' phase is reduced and sufficient strength cannot be obtained. On the other hand, in a case where the value is higher than 5.5%, the thermal expansion coefficient increases. Therefore, the value of Al+Ti+Nb capable of appropriately balancing the strength and the thermal expansion coefficient is 3.5% or higher and smaller than 5.5%. In a case where low thermal expansion coefficient is regarded as important, an upper limit of Al+Ti+Nb is preferably 4.7%.

An object of the present invention is to provide a low thermal expansion superalloy suitable for manufacturing a large sized product. In order for the object, it is necessary to manufacture a robust large sized ingot. In order to manufacture a robust large sized ingot, that is, a large sized ingot without a macrosegregation during solidification, it is effective to control density difference between an alloy liquid phase and concentrated liquid phase, that is, difference in molten metal densities. If density of the concentrated liquid phase is higher than that of the alloy liquid phase, sedimentation type freckle segregation is likely to occur, and if density of the concentrated liquid phase is smaller than that of the alloy liquid phase, floating type freckle segregation is likely to occur. The closer the difference in molten metal densities is to zero, the less the occurrence of freckle segregation. Therefore, it becomes easy to manufacture the large sized ingot without macrosegregation.

The present inventors have found the difference in molten metal densities of the low thermal expansion superalloy and have conducted intensive studies on chemical compositions affecting the difference in molten metal densities. As a result, it is newly found that an F value which is calculated based on $F\ value = 0.0014Ni + 0.6Co - 6.8Al + 7.6Ti - 5.3Nb - 0.11Fe$ shows a good correlation with the difference in molten metal densities. In a case where the density of the concentrated liquid phase is higher, the F value becomes a negative value, and in a case where the density of the alloy liquid phase is higher, the F value becomes a positive value. In either case, as an absolute value of the F value is closer to zero, the freckle segregation is less likely to occur. In a case where the absolute value of the F value is higher than 8%, the freckle segregation is likely to occur and it is difficult to manufacture the large sized ingot. Therefore, the absolute value of the F value is 8% or smaller. The absolute value of the F value is preferably 6% or smaller.

B is an element that is segregated at the grain boundary of austenite grain to increase strength of the grain boundary and enhances hot workability, creep strength, and ductility. However, in a case where B is less than 0.001%, an amount of B segregated at the grain boundary is small, it is difficult to obtain sufficient strength of the grain boundary. On the other hand, B exceeds 0.01%, boride is formed to hinder the hot workability. Therefore, B is set to 0.001% to 0.01%. A lower limit of B is preferably 0.002%, and an upper limit of B is preferably 0.006%. The upper limit of B is more preferably 0.005%.

In a case where C has suppressed as low as 0.1% or less, since an amount of carbide precipitated at the grain boundary becomes excessively small, S that has segregated at the grain boundary cannot be fixed and the hot workability is likely to deteriorate due to the S segregated at the grain boundary. Therefore, Mg binds to S segregated at the grain boundary to fix S and has an effect of improving the hot workability. In a case where Mg is less than 0.0005%, an effect thereof is not sufficient. On the other hand, in a case where Mg exceeds 0.01%, an amount of an oxide or a sulfide increases to deteriorate cleanliness as an inclusion or an amount of a compound with Ni having a low melting point increases to deteriorate the hot workability. Therefore, Mg is limited to 0.0005% to 0.01%. A lower limit of Mg is preferably 0.001% and an upper limit of Mg is preferably 0.007%. The upper limit of Mg is more preferably 0.005%.

Note that some or all of Mg may be substituted with Ca, in this case, (Mg+0.6×Ca) may be limited to a range of Mg alone.

Since an object of adding Mg is to improve the hot workability by fixing S of impurities that is segregated at the grain boundary, Mg content is specified according to S content. In order to effectively fix S, it is necessary that a mass ratio of Mg to S is 1:1 or more. Therefore, a value of Mg/S is limited to 1 or more. In a case where some or all or Mg has been substituted with Ca, it is preferable that (Mg+0.6×Ca)/S is limited to 1 or more.

In addition to the above described elements, in the present invention, it is possible to include Cr as an optional element. Cr forms a solid solution in the austenite matrix including Fe, Ni, and Co as main constituents. Cr is an element that forms a solid solution in an oxide layer which is formed, on a surface, in a case where the alloy of the present invention is oxidized at high temperature and includes Fe, Ni, Co, and the like as main constituents so as to improve the oxidation resistance, and is an optional element which can be added in a case of being used at high temperature. In order to obtain the effect of Cr, Cr is preferably set to 0.1% or more. In a case where Cr is 1.7% or more, the Curie point is lowered to increase the thermal expansion coefficient. Therefore, Cr is set to 0.1% or more and less than 1.7%. A lower limit of Cr is preferably 0.4%, and the lower limit of Cr is more preferably 0.7%. In addition, an upper limit of Cr is preferably 1.6%, and the upper limit of Cr is more preferably 1.3%.

In the present invention, a remainder is Fe. Naturally, impurities are included.

P and S which are impurities are likely to be segregated at the grain boundary and cause high temperature strength or hot workability to be deteriorated. P may be limited to 0.02% or less and S may be limited to 0.005% or less. S is preferably 0.003% or less and more preferably 0.002% or less. In addition, O and N bind to Al, Ti, Nb, and the like to form oxide-based or nitride-based inclusion, such that cleanliness is deteriorated and the fatigue strength is deteriorated. Also, there is a concern that an amount of Al, Ti, and Nb that form the γ' phase decreases to inhibit an increase in strength due to precipitation hardening. Therefore, it is preferable to suppress O and N as lower as possible. Accordingly, preferably O may be 0.008% or less, N may be 0.004% or less. More preferably O may be 0.005% or less and N may be 0.003% or less. In addition, Ag, Sn, Pb, As, and Bi are also impurity elements that are segregated at the austenite grain boundary to deteriorate high temperature strength. It is preferable that Ag, Sn, Pb, As, and Bi is limited to 0.01% or less in total.

In a case where addition of Nb performed, a small amount of Ta may be mixed as impurities in some cases. However, in this case, 0.5×Ta and Nb are regarded as equivalent to each other by mass %. Therefore, the range of Nb may be replaced with Nb+0.5×Ta. In addition, Zr is segregated at the grain boundary to improve the hot workability. However, in a case where Zr is excessively added or mixed therein, a brittle compound is adversely generated to hinder the hot workability. Therefore, Zr may be 0.05% or less. In addition, Cu, Mo, and W may increase the thermal expansion coefficient. Therefore, Cu, Mo, and W may be 0.5% or less, and more preferably may be 0.3% or less.

Next, a reason for limiting a structure will be described.

In the alloy of the present invention, in order to obtain favorable high temperature strength and ductility, particularly excellent creep strength and ductility, it is necessary to strengthen the grain boundary of the austenite matrix. In the alloy of the present invention, a structure in which an intermetallic compound (Laves phase) containing one or more elements of Si, Nb, and Ni alone or in a total amount of 36 mass % or more has been precipitated at the grain boundary of the austenite matrix can be obtained by optimizing the chemical compositions described above. The intermetallic compound containing one or more elements of Si, Nb, and Ni alone or in a total amount of 36 mass % or more suppresses grain boundary sliding due to creep to increase the strength of grain boundary, thereby enhancing creep strength and ductility. In particular, notch creep rupture susceptibility greatly improves. The intermetallic compound containing one or more elements of Si, Nb, and Ni alone or in a total amount of 36 mass % or more is discontinuously granularly precipitated at the grain boundary of the austenite matrix, thereby effectively strengthening the grain boundary. The intermetallic compound includes one or more elements of Si, Nb, and Ni alone or in a total amount of preferably 37 mass % or more and more preferably 40 mass % or more. A method for causing precipitation of the intermetallic compound will be described. Note that a quantitative analysis of the intermetallic compound is conveniently performed, for example, using an energy dispersive X-ray analyzer (EDX) when observing with a scanning electron microscope (SEM).

In the alloy of the present invention, in order to obtain favorable high temperature strength and ductility, particularly excellent creep strength and ductility, it is necessary to strengthen even in the austenite matrix (in the grain). In the alloy of the present invention, an intermetallic compound including a larger concentration of Ni, Al, Ti, and Nb than that of the alloy can be finely dispersed in the austenite matrix (in the grain) by optimizing the chemical compositions. The intermetallic compound is a precipitation-hardening phase called by a γ' (gamma prime) phase, and can enhance the strength at room temperature and high temperature by fine precipitation of the γ' phase. Here, since a γ' phase particle to be precipitated is not complete spherical shape, a diameter is expressed by a circle equivalent diameter that can be measured from cross section observation. In addition, since the diameter also has a distribution, the diameter is expressed using the average diameter. In a case where the diameter of the γ' phase is greater than 50 nm, an effect as a strengthened phase is small, therefore the diameter of the γ' phase is set to 50 nm or smaller. The diameter of γ' phase may be preferably 30 nm or smaller, and more preferably 20 nm or smaller. The method for causing precipitation of the γ' phase will be described later. Although a presence or an absence of the γ' phase can be confirmed with SEM, for confirming a larger concentration of Ni, Al, Ti, and Nb which form γ' phase than that of the alloy, an analysis is conveniently performed, for example, using the EDX when observed with a transmission electron microscope (TEM). In addition, in order to obtain the diameter of the γ' phase, for example, after 30 or more γ' phases observed in the observation field are randomly selected to measure the diameters thereof, the average value thereof may be calculated.

The alloy of the present invention is characterized in that favorable tensile ductility is obtained at room temperature in a state where solution treatment has been performed, and forming at room temperature is possible. For this reason, it is preferable that reduction of area when fracturing due to a tensile test at room temperature is 50% or higher.

In addition, the alloy of the present invention is characterized in that a low thermal expansion coefficient, high strength, low notch creep rupture susceptibility, and favorable oxidation resistance are obtained in a state where the aging treatment has been performed after the solution treatment. Here, the notch creep rupture susceptibility can be evaluated using a combination smooth/notched creep test piece having a notch and a smooth parallel portion in series in an axial direction of single test piece. An alloy having high notch sensitivity ruptures in a notch portion in a relatively short time. On the contrary, an alloy having low notch sensitivity shows favorable elongation at the smooth parallel portion and then ruptures. Therefore, in the combination smooth/notched creep test, rupturing at the parallel portion is a criterion of determination of low notch sensitivity. Preferable characteristics are as follows: an average thermal expansion coefficient at 30° C. to 500° C. is $8.1\times10^{-6}$/° C. or lower; tensile strength at room temperature is 780 MPa or higher; tensile strength at 550° C. is 600 MPa or higher; a parallel portion ruptures under a stress of 510 MPa at 650° C. after 10% or higher of elongation in a combination smooth/notched creep test; and an oxide layer is not-spalled and an oxidation weight gain is 1.3 mg/cm$^2$ or less in an oxidation test at 600° C. in the air for 100 hours. It is preferable that the average thermal expansion coefficient at 30° C. to 500° C. is low. It is possible to set the average thermal expansion coefficient at 30° C. to 500° C. to a lower value by combining the composition and the manufacturing method with good balance. The average thermal expansion coefficient at 30° C. to 500° C. is preferably $7.9\times10^{-6}$/° C. or lower, more preferably $7.7\times10^{-6}$/° C. or lower, still more preferably $7.5\times10^{-6}$/° C. or lower, and still further preferably $7.4\times10^{-6}$/° C. or lower. In addition, the oxidation weight gain is preferably less than 1.2 mg/cm$^2$ and more preferably 1.0 mg/cm$^2$ or less.

Note that an expression "the oxide layer is not spalled" in the present invention means that an oxide layer that has been spalled and fallen out and that can be visually observed is not observed in the vicinity of the test piece after an oxidation test.

Next, a manufacturing method for the low thermal expansion superalloy of the present invention will be described.

The alloy composition is as described above. In order to reduce the impurities, it is preferable that the vacuum induction melting (VIM) is performed as melting. Further, in order to obtain a low level of impurities in a mass production scale of manufacturing, it is preferable that the ingot is manufactured by melting with a combination of the vacuum induction melting and the vacuum arc remelting (VAR). In a case where cost performance is further considered, it is more preferable that the ingot is manufactured by melting with a combination of vacuum induction melting (VIM) and electroslag remelting (ESR). In addition, in a case where the ESR is used, it is possible to effectively reduce S. Therefore, in a case of the alloy of the present invention in which S is intended to be limited to a low level, it is preferable that the ESR melting is employed. In a case where an ingot is intended to be manufactured in a larger size without macrosegregation, when the vacuum arc remelting exhibiting fast solidification rate is used, it is possible to manufacture a larger sized ingot than that manufactured by using the electroslag remelting. In a case where the vacuum arc remelting or the electroslag remelting is adopted after the vacuum induction melting, a consumable electrode is produced by vacuum induction melting and the ingot is manufactured using the consumable electrode by the vacuum arc remelting or the electroslag remelting. In addition, when the consumable electrode is produced by vacuum induction melting and then the ingot is produced using the consumable electrode by the electroslag remelting and finally the vacuum arc remelting is performed using the ingot, it is possible to produce a more homogeneous ingot.

Hot plastic working is performed once or more by using the ingot of low thermal expansion superalloy and a recrystallized forged structure is obtained, and then the solution treatment is performed at 850° C. to 1080° C., thereby obtaining a structure in which an appropriate amount of a granular intermetallic compound containing one or more elements of Si, Nb, and Ni alone or in a total amount of 36 mass % or more is precipitated discontinuously at the grain boundary of the austenite matrix. In a case where a temperature of the solution treatment is lower than 850° C., a large amount of the intermetallic compound remains in an undessolved state. On the other hand, in a case where the temperature of the solution treatment is higher than 1080° C., an amount of the intermetallic compound precipitated at the grain boundary decreases and austenite grain is coarsened. Therefore, the solution treatment is set to 850° C. to 1080° C. A lower limit of the temperature of the solution treatment is preferably 900° C. and an upper limit of the temperature of the solution treatment is preferably 960° C. Cooling after the solution treatment is desirably performed at a cooling rate equal to or higher than that of air cooling. Preferably the cooling may be oil cooling and more preferably the cooling may be water cooling.

After the solution treatment, the aging treatment is performed at least once at 580° C. to 700° C. for 8 to 100 hours, thereby the γ' phase is finely precipitated in which Ni, Al, Ti, and Nb are concentrated more than in the alloy and of which the diameter is 50 nm or smaller, at the austenite matrix. It is possible to obtain high strength and low thermal expansion coefficient. In a case where the temperature of the aging treatment is lower than 580° C., an amount of the γ' phase precipitated decreases and it is difficult to obtain the high strength. On the other hand, the temperature of the aging treatment is higher than 700° C., an amount, a morphology, a composition of the precipitated phase change and it is difficult to obtain the low thermal expansion coefficient. Therefore the temperature of the aging treatment is set to 580° C. to 700° C. An upper limit of aging temperature is preferably 680° C. and more preferably 650° C. Favorable characteristics can be obtained by performing holding for 8 to 100 hours. Therefore, aging treatment time is 8 to 100 hours. The aging treatment time may be preferably 20 to 70 hours and more preferably 30 to 60 hours. The aging treatment may be performed once, and may be performed by dividing into two or more times while changing the temperature within the range of 580° C. to 700° C.

In addition, for example, even after the aging treatment for the first time has been performed at a temperature of higher than 700° C. and 730° C. or lower for a short time approximately 10 hour or less, when the aging treatment for the second time and subsequent aging treatments are performed at the temperature within the range of 580° C. to 700° C. for 8 to 100 hours, it is possible to cause precipitation of γ' phase of 50 nm or smaller in the austenite grain. Further, for example, after the aging treatment for the first time has been performed at a temperature of higher than 700° C. and 730° C. or lower for a short time approximately 10 hour or less, when the aging treatment is performed at the temperature within the range of 580° C. to 700° C. for long time of 20 to 100 hours, the γ' phase becomes fine. Accordingly, the γ' phase of 50 nm or smaller can be made, which is comparable to that obtained by performing aging treatment only once at 580° C. to 700° C. for a long time. Specific examples are shown in the Examples which will be described later.

EXAMPLES 10 kg of ingot was produced by vacuum induction melting. Chemical compositions of produced alloys Nos. 1 to 5 which are within a range of composition according to the present invention and comparative alloys Nos. 21 to 24 are shown in Tables 1 and 2. Since the absolute value of the F value is 8% or smaller in alloys Nos. 1 to 5, in a case where a large sized ingot was manufactured by the vacuum arc remelting or the electroslag remelting after vacuum melting in a mass production, the alloys can be manufactured without a problem of macrosegregation. Note that the remainder is Fe and impurities.

TABLE 1

| No. | C | Si | Mn | S | Ni | Cr | Co | Al | Ti | Nb | B | (mass %) Mg |
|---|---|---|---|---|---|---|---|---|---|---|---|---|
| 1 | 0.030 | 0.40 | 0.11 | 0.0007 | 26.85 | — | 20.90 | 0.40 | 0.95 | 2.85 | 0.004 | 0.0023 |
| 2 | 0.032 | 0.40 | 0.10 | 0.0010 | 27.85 | — | 19.12 | 0.40 | 0.94 | 2.84 | 0.004 | 0.0015 |
| 3 | 0.030 | 0.42 | 0.10 | 0.0009 | 26.73 | 0.97 | 20.90 | 0.40 | 0.94 | 2.86 | 0.003 | 0.0022 |
| 4 | 0.031 | 0.41 | 0.11 | 0.0008 | 27.88 | 0.98 | 19.04 | 0.39 | 0.94 | 2.85 | 0.004 | 0.0019 |
| 5 | 0.031 | 0.42 | 0.11 | 0.0008 | 27.90 | 0.97 | 19.03 | 0.59 | 0.85 | 2.86 | 0.004 | 0.0025 |
| 21 | 0.031 | 0.43 | 0.10 | 0.0002 | 29.64 | — | 19.54 | 0.57 | 1.27 | 4.06 | 0.004 | 0.0008 |
| 22 | 0.031 | 0.43 | 0.10 | 0.0004 | 26.77 | — | 20.77 | 0.41 | 0.96 | 3.06 | 0.003 | 0.0006 |
| 23 | 0.029 | 0.41 | 0.10 | 0.0004 | 35.58 | — | 17.34 | 0.34 | 0.80 | 2.55 | 0.004 | 0.0008 |
| 24 | 0.032 | 0.41 | 0.11 | 0.0009 | 27.83 | — | 19.14 | 1.21 | 0.87 | 2.80 | 0.004 | 0.0047 |

Balance is Fe and inevitable impurities

TABLE 2

| No. | Mg/S | 1.235Ni + Co | Al + Ti + Nb | F value | Remarks |
|---|---|---|---|---|---|
| 1 | 3.29 | 54.06 | 4.20 | −3.25 | Composition of Present Invention |
| 2 | 1.50 | 53.51 | 4.18 | −4.43 | Composition of Present Invention |
| 3 | 2.44 | 53.91 | 4.20 | −3.29 | Composition of Present Invention |
| 4 | 2.38 | 53.47 | 4.18 | −4.36 | Composition of Present Invention |
| 5 | 3.13 | 53.49 | 4.30 | −6.45 | Composition of Present Invention |
| 21 | 4.00 | 56.15 | 5.90 | −8.86 | Composition of Comparative Example |
| 22 | 1.50 | 53.83 | 4.43 | −4.43 | Composition of Comparative Example |
| 23 | 2.00 | 61.28 | 3.69 | −4.01 | Composition of Comparative Example |
| 24 | 5.22 | 53.51 | 4.88 | −10.17 | Composition of Comparative Example |

After the ingots shown in Tables 1 and 2 was subjected to homogenization at 1180° C. for 20 hours, hot forging (hot plastic working) was performed, and then it was finished into a bar having a cross section of 30 mm×30 mm. Since both of the alloys within a range of composition according to the present invention and comparative alloys satisfied Mg/S or 1 or higher, the hot forging can eliminate a problem of cracking. Note that, in the alloys having a composition according to the present invention, a freckle segregation was not observed.

Then, the solution treatment was performed by air cooling after performing holding at 930° C. for 1 h and the tensile test was performed at room temperature (25° C.). In the tensile test, a round—bar test piece in which a parallel portion is 6.0 mm and gauge length is 30 mm was collected along a longitudinal direction of a bar, the test piece was tested at room temperature according to JIS, and 0.2% proof stress, tensile strength, elongation, and reduction of area were measured. The results thereof are shown in Table 3.

TABLE 3

| No. | 0.2% Proof stress (MPa) | Tensile strength (MPa) | Elongation (%) | Reduction of area (%) | Remarks |
|---|---|---|---|---|---|
| 1 | 644 | 812 | 21.0 | 53.9 | Example of Present Invention |
| 2 | 605 | 780 | 23.7 | 58.0 | Example of Present Invention |
| 3 | 567 | 783 | 25.4 | 55.4 | Example of Present Invention |
| 4 | 549 | 766 | 25.5 | 57.2 | Example of Present Invention |
| 5 | 588 | 776 | 22.8 | 53.7 | Example of Present Invention |
| 21 | 551 | 819 | 27.1 | 48.2 | Comparative Example |
| 22 | 606 | 771 | 24.6 | 56.3 | Comparative Example |
| 23 | 441 | 690 | 31.7 | 72.3 | Comparative Example |
| 24 | 617 | 825 | 24.0 | 55.1 | Comparative Example |

Further, the aging treatment in various conditions specified in the present invention was performed after the solution treatment. The conditions of the aging treatment are as six conditions below.

(1) 720° C.×8 h→(50° C./h)→620° C.×8 h, air cooling (2) 670° C.×50 h, air cooling (3) 700° C.×50 h, air cooling (4) 720° C.×8 h→(50° C./h)→620° C.×8 h, air cooling+600° C.×50 h, air cooling (5) 600° C.×50 h, air cooling (6) 620° C.×50 h, air cooling In Tables 4 and 5, specific treatment conditions are described together with the numbers in brackets ( ). In Tables 6 and 7, only the numbers in brackets ( ) are described.

In addition, an expression "(50° C./h)" in the aging treatment shown in (1) and (4) represents a cooling rate per an hour.

After the aging treatment, microstructure observation, thermal expansion coefficient measurement, tensile test at room temperature and 550° C., measurement for an increase oxidation weight gain after holding at 600° C.×100 hours in the air, and a combination smooth/notched rupture test in which a test piece having a notch portion and a parallel portion in series was used were carried out.

In the microstructure observation, a cross section of the bar, which is parallel with a longitudinal direction of the bar, is polished and etched, and the intermetallic compound precipitated at the grain boundary is observed using an optical microscope and SEM. The chemical compositions was analyzed by measuring using an EDX analysis of the SEM. In addition, γ' phase precipitated in the grain were observed using the SEM. Since each γ' phase is not necessarily spherical shape, 30 or more diameters were measured using a circle equivalent diameter. Chemical compositions of γ' phase was analyzed by cutting a thin film sample, observing the sample using a TEM, and measuring using EDX analysis. Note that γ' phase is described by "precipitation in grain" in Table 4 and by "precipitated phase in grain" in Table 5.

In the measurement for the thermal expansion coefficient, a test piece having 5 mm of diameter and 20 mm of length along the longitudinal direction of the bar was taken, the average thermal expansion coefficient was measured by differential thermal expansion measuring up to 500° C. from a base of 30° C.

In the tensile test, a round—bar test piece in which a parallel portion is 6.0 mm and gauge length is 30 mm was taken along a longitudinal direction of a bar, the test piece was tested at room temperature and 550° C. according to JIS, and 0.2% proof stress, tensile strength, elongation, and reduction of area were measured.

Regarding the oxidation weight gain, a test piece of which a diameter is 10 mm and a length is 20 mm was taken along the longitudinal direction of the bar, was inserted into an electric furnace kept at 600° C. in the air, was extracted after exposing for 100 hours, and was cooled to the room temperature, and weights thereof before and after heating were measured to obtain the oxidation weight gain. A state of spalled oxide layer was visually confirmed.

In the combination smooth/notched rupture test, on the basis of ASTM, a test piece of which a diameter of the parallel portion and a diameter of notch root were 4.52 mm, an outer diameter of notch was 6.35 mm, a radius of notch was 0.13 mm, and a length of the parallel portion was 19.05 mm was used to be tested at 650° C. and under 510 MPa of a stress, and rupture time, rupture position, elongation after rupture, and reduction of area when rupturing were measured. The results thereof are shown in Tables 4 to 7.

TABLE 4

| No. | Solution treatment | Aging treatment | Matrix | Discontinuous precipitation at grain boundary | Fine precipitation in grain | Average thermal expansion coefficient 30° C. to 500° C. ($\times 10^{-6}$/° C.) | Remarks |
|---|---|---|---|---|---|---|---|
| 1 | 930° C. × 1 h, air cooling | (1) 720° C. × 8 h → (50° C./h) → 620° C. × 8 h, air cooling | γ phase | ○ | ○ | 7.04 | Present Invention |
| | | (2) 670° C. × 50 h, air cooling | γ phase | ○ | ○ | 6.77 | Present Invention |
| 2 | 930° C. × 1 h, air cooling | (1) 720° C. × 8 h → (50° C./h) → 620° C. × 8 h, air cooling | γ phase | ○ | ○ | 7.22 | Present Invention |
| | | (2) 670° C. × 50 h, air cooling | γ phase | ○ | ○ | 7.17 | Present Invention |
| | | (3) 700° C. × 50 h, air cooling | γ phase | ○ | ○ | 7.32 | Present Invention |
| 3 | 930° C. × 1 h, air cooling | (1) 720° C. × 8 h → (50° C./h) → 620° C. × 8 h, air cooling | γ phase | ○ | ○ | 7.63 | Present Invention |
| | | (4) 720° C. × 8 h → (50° C./h) → 620° C. × 8 h, air cooling + 600° C. × 50 h, air cooling | γ phase | ○ | ○ | 7.47 | Present Invention |
| | | (5) 600° C. × 50 h, air cooling | γ phase | ○ | ○ | 7.39 | Present Invention |
| | | (6) 620° C. × 50 h, air cooling | γ phase | ○ | ○ | 7.10 | Present Invention |
| | | (2) 670° C. × 50 h, air cooling | γ phase | ○ | ○ | 7.66 | Present Invention |
| | | (3) 700° C. × 50 h, air cooling | γ phase | ○ | ○ | 7.85 | Present Invention |
| 4 | 930° C. × 1 h, air cooling | (1) 720° C. × 8 h → (50° C./h) → 620° C. × 8 h, air cooling | γ phase | ○ | ○ | 7.81 | Present Invention |
| 5 | 930° C. × 1 h, air cooling | (1) 720° C. × 8 h → (50° C./h) → 620° C. × 8 h, air cooling | γ phase | ○ | ○ | 8.04 | Present Invention |
| 21 | 930° C. × 1 h, air cooling | (1) 720° C. × 8 h → (50° C./h) → 620° C. × 8 h, air cooling | γ phase | ○ | ○ | 7.34 | Comparative Example |
| 22 | 930° C. × 1 h, air cooling | (1) 720° C. × 8 h → (50° C./h) → 620° C. × 8 h, air cooling | γ phase | ○ | ○ | 7.11 | Comparative Example |
| 23 | 930° C. × 1 h, air cooling | (1) 720° C. × 8 h → (50° C./h) → 620° C. × 8 h, air cooling | γ phase | x | ○ | 8.48 | Comparative Example |
| 24 | 930° C. × 1 h, air cooling | (1) 720° C. × 8 h → (50° C./h) → 620° C. × 8 h, air cooling | α' phase | ○ | ○ | 11.43 | Comparative Example |

TABLE 5

| No. | Solution treatment | Aging treatment | Concentration of Si + Nb + Ni in precipitated phase at grain boundary (mass %) | Concentration in finely precipitated phase in grain (mass %) | | | | Circle equivalent diameter of finely precipitated phase in grain | Remarks |
|---|---|---|---|---|---|---|---|---|---|
| | | | | Ni | Al | Ti | Nb | | |
| 3 | 930° C. × 1 h, air cooling | (1) 720° C. × 8 h → (50° C./h) → 620° C. × 8 h, air cooling | 38.55 | 30.3 | 1.5 | 1.5 | 3.7 | 25.5 | Present Invention |
| | | (4) 720° C. × 8 h → (50° C./h) → 620° C. × 8 h, air cooling + 600° C. × 50 h, air cooling | 39.13 | — | — | — | — | 10.3 | Present Invention |
| | | (5) 600° C. × 50 h, air cooling | 44.77 | — | — | — | — | 8.8 | Present Invention |

TABLE 5-continued

| No. | Solution treatment | Aging treatment | Concentration of Si + Nb + Ni in precipitated phase at grain boundary (mass %) | Concentration in finely precipitated phase in grain (mass %) Ni | Al | Ti | Nb | Circle equivalent diameter of finely precipitated phase in grain | Remarks |
|---|---|---|---|---|---|---|---|---|---|
| | | (6) 620° C. × 50 h, air cooling | 41.66 | 31.1 | 1.3 | 1.6 | 4.2 | 10.1 | Present Invention |
| | | (3) 700° C. × 50 h, air cooling | 40.66 | — | — | — | — | 27.9 | Present Invention |

* 1. "—" represents having not measured.

TABLE 6

| No. | Aging treatment | Tensile characteristics at room temperature: 0.2% Proof stress (MPa) | Tensile strength (MPa) | Elongation (%) | Reduction of area (%) | Tensile characteristics at high temperature (550° C.): 0.2% Proof stress (MPa) | Tensile strength (MPa) | Elongation (%) | Reduction of area (%) | Remarks |
|---|---|---|---|---|---|---|---|---|---|---|
| 1 | (1) | 660 | 1220 | 24.0 | 42.0 | 676 | 835 | 14.4 | 48.3 | Present Invention |
| | (2) | 720 | 1203 | 23.3 | 47.0 | 650 | 859 | 17.1 | 50.9 | Present Invention |
| 2 | (1) | 719 | 1225 | 24.8 | 44.6 | 680 | 853 | 14.2 | 45.5 | Present Invention |
| | (2) | 883 | 1137 | 27.3 | 47.0 | 658 | 865 | 16.1 | 49.7 | Present Invention |
| | (3) | 774 | 962 | 23.0 | 52.0 | 558 | 774 | 17.9 | 51.8 | Present Invention |
| 3 | (1) | 846 | 1039 | 24.5 | 53.5 | 677 | 855 | 14.7 | 48.8 | Present Invention |
| | (4) | 904 | 1115 | 27.8 | 49.7 | 750 | 906 | 15.1 | 49.0 | Present Invention |
| | (5) | 1035 | 1333 | 27.4 | 41.0 | 727 | 962 | 14.3 | 48.3 | Present Invention |
| | (6) | 1013 | 1250 | 25.0 | 42.9 | 747 | 987 | 16.7 | 49.9 | Present Invention |
| | (2) | 865 | 1049 | 16.6 | 48.0 | 638 | 871 | 17.6 | 51.6 | Present Invention |
| | (3) | 729 | 956 | 22.2 | 52.4 | 511 | 780 | 20.1 | 55.6 | Present Invention |
| 4 | (1) | 860 | 1064 | 22.0 | 51.1 | 685 | 874 | 14.6 | 48.2 | Present Invention |
| 5 | (1) | 865 | 1066 | 20.6 | 49.6 | 692 | 877 | 14.0 | 47.1 | Present Invention |
| 21 | (1) | 1043 | 1289 | 24.3 | 33.4 | 823 | 1059 | 14.2 | 36.2 | Comparative Example |
| 22 | (1) | 529 | 1259 | 21.5 | 40.3 | 668 | 846 | 16.7 | 50.6 | Comparative Example |
| 23 | (1) | 726 | 1044 | 22.7 | 59.4 | 569 | 797 | 19.4 | 57.7 | Comparative Example |
| 24 | (1) | 969 | 1734 | 11.4 | 24.8 | 505 | 1140 | 38.3 | 81.0 | Comparative Example |

* The solution treatment before the aging treatment is performed at 930° C. × 1 h by air cooling.

TABLE 7

| No. | Aging treatment | Increase amount of oxidation ($mg/cm^3$) (600° C. × 100 h) | Presence or absence of oxide film peeled off | Composite rupture (650° C.-510 MPa): Fracture time (h) | Elongation (%) | Reduction of area (%) | Fracture position | Remarks |
|---|---|---|---|---|---|---|---|---|
| 1 | (1) | 1.3 | Absence | — | — | — | — | Present Invention |
| 2 | (1) | 1.2 | Absence | 44.6 | 24.4 | 54 | Parallel portion | Present Invention |
| 3 | (1) | 0.9 | Absence | 59.2 | 20.1 | 61 | Parallel portion | Present Invention |

TABLE 7-continued

| No. | Aging treatment | Increase amount of oxidation ($mg/cm^3$) (600° C. × 100 h) | Presence or absence of oxide film peeled off | Composite rupture (650° C.-510 MPa) Fracture time (h) | Elongation (%) | Reduction of area (%) | Fracture position | Remarks |
|---|---|---|---|---|---|---|---|---|
| | (4) | — | — | 22.2 | 26.7 | 65.3 | Parallel portion | Present Invention |
| | (5) | 0.6 | Absence | 124.6 | 25.7 | 58.8 | Parallel portion | Present Invention |
| | (6) | 0.7 | Absence | 117.7 | 23.5 | 61 | Parallel portion | Present Invention |
| 4 | (1) | 0.9 | Absence | — | — | — | — | Present Invention |
| 5 | (1) | 1.0 | Absence | — | — | — | — | Present Invention |
| 21 | (1) | 1.2 | Absence | 187.7 | 21.2 | 52.4 | Parallel portion | Comparative Example |
| 22 | (1) | 1.6 | Absence | 16.8 | 27.2 | 62.1 | Parallel portion | Comparative Example |
| 23 | (1) | 1.0 | Absence | — | — | — | — | Comparative Example |
| 24 | (1) | 2.3 | Absence | — | — | — | — | Comparative Example |

* 1. The solution treatment before the aging treatment is performed at 930° C. × 1 h by air cooling.
* 2. "—" represents having not tested.

From Table 3, it can be seen that all of Nos. 1 to 5 which are within a range of composition according to the present invention have 50% or higher of reduction of area when fractured due to a room temperature tensile test in the solution treated state and have favorable formability. Nos. 22 to 24 of Comparative Example also exhibits favorable reduction of area when fractured, but No. 21 has less than 50% of reduction of area when fractured and has degraded formability comparing to the alloys which are within a range of composition according to the present invention. It is considered that since a large amount of Nb is included, the large amount of intermetallic compound including Si, Nb, and Ni is present in the grain before the aging treatment, therefore the reduction of area was lowered.

As shown in Tables 4 to 7, it was confirmed that, in all of alloys Nos. 1 to 5 of the present invention, a matrix structure is an austenite phase (γ phase), the intermetallic compound including a large amount of Si, Nb, and Ni at the austenite grain boundary is discontinuously precipitated at the grain boundary, the γ' phase having a diameter of 50 nm or smaller is finely precipitated in the austenite grain, and the γ' phase includes a larger concentration of Al, Ti, Nb, and Ni than that of the alloys shown in Table 1. As an example, the alloy No. 3 of the present invention in which a condition of the aging treatment was changed exhibits an analysis value of chemical compositions of the precipitated phase at the grain boundary, an analysis value of chemical compositions of the γ' phase (finely precipitated phase in grain), and the average diameter of the γ' phase are shown in Table 5; a total amount of Si, Nb, and Ni in the precipitated phase at the grain boundary is 36% or higher. In addition, Ni, Al, Ti, and Nb in the γ' phase are condensed to be in a larger amount than the value in the alloy and the average diameter is 50 nm or smaller.

In addition, as shown in Table 5, although the alloy No. 3 of the present invention for which the aging treatment was performed under Condition (4) is aging treated for the first time at 720° C. for 8 hours, the final aging treatment (third time) was performed under the condition of 600° C. for 50 h, accordingly, the average circle equivalent diameter of the γ' phase was 10.4 nm. The average circle equivalent diameter of the γ' phase was much finer than that in Condition (1) in which the final aging treatment at the 600° C. for 50 h was not performed, and was an average circle equivalent diameter comparable to that of Condition (5).

From the result, it can be seen that the condition of the finally performed aging treatment greatly affects the size of the γ' phase in austenite grain.

On the other hand, since the comparative alloy No. 23 included a large amount of Ni, solid solubility of the intermetallic compound was high and the intermetallic compound including Si, Nb, and Ni was not sufficiently precipitated at the grain boundary. In addition, in the comparative alloy No. 24, a large amount of Al is included, an amount of γ' phase precipitated increases, and the balance of the matrix composition is changed. Since the matrix is transformed to the martensite structure (α' phase), the thermal expansion coefficient greatly increases.

In the alloys of the present invention and comparative alloys excluding No. 21, since a value of Al+Ti+Nb is equal to or higher than the specified lower limit value, the tensile strength at room temperature and 550° C. satisfies 780 MPa and 600 MPa, respectively. In the comparative alloy No. 21, since a value of Al+Ti+Nb exceeds the specified upper limit value, an amount of precipitation hardening increases, on the other hand, ductility is deteriorated. A value of reduction of area is lower than that of the alloys of the present invention.

In addition, the alloys of the present invention satisfy 1.3 $mg/cm^2$ of the oxidation weight gain after heating at 600° C. for 100 hours in the air. In particular, in the alloys Nos. 3 to 5 of the present invention that include Cr, the oxidation weight gain is further small and the oxidation resistance is favorable. In the comparative alloy No. 22, since an amount of Nb is larger than that of the alloy No. 1 of the present invention, the oxidation weight gain is large and the oxidation resistance is not favorable. On the other hand, in the comparative alloy No. 24 in which the matrix structure is a martensite structure, the oxidation weight gain is large and the oxidation resistance is not favorable. All of alloys for which the combination smooth/notched rupture test was carried out include Si. The intermetallic compound including Si, Nb, and Ni discontinuously covers the grain boundary. It is possible to suppress intergranular fracture due to oxidation at the grain boundary. Therefore, the parallel portion exhibits 10% or higher of elongation and then ruptures. Accordingly, it can be seen that the notch sensitivity is low.

INDUSTRIAL APPLICABILITY

As above, using the alloys of the present invention, it is possible to manufacture a large sized ingot without a concern of macrosegregation. The alloys of the present invention can be formed in a solution treated state. If the aging treatment is appropriately performed, it is possible to obtain a low thermal expansion coefficient, high tensile strength from room temperature to high temperature, favorable oxidation resistance, and favorable creep ductility. Therefore, in a case where the alloy of the present invention is used for applications such as a large gas turbine part, a part joining with ceramics, glass, or the like, a part joining with a cemented carbide, and the like, it is possible to maintain a small clearance between parts in a range from room temperature to high temperature and it is possible to obtain a relatively favorable oxidation resistance and stable high strength, thereby achieving higher reliability.

The invention claimed is:

1. A low thermal expansion superalloy including, in terms of mass %, 0.1% or less of C, 0.1% to 1.0% of Si, 1.0% or less of Mn, 25% to 32% of Ni, more than 18% and less than 24% of Co, more than 0.25% and 1.0% or less of Al, 0.5% to 1.5% of Ti, more than 2.1% and less than 3.0% of Nb, 0.001% to 0.01% of B, 0.0005% to 0.01% of Mg, a remainder of Fe, and inevitable impurities, wherein relationships of:

$Mg/S \geq 1$, $52.9\% \leq 1.235Ni+Co < 55.8\%$, 3.5% or more and less than 5.5% of Al+Ti+Nb, and 8% or less of an absolute value of F value are satisfied, wherein the F value is calculated based on:

F value=0.0014Ni+0.6Co−6.8Al+7.6Ti−5.3Nb−0.11Fe, wherein a granular intermetallic compound containing one or more elements of Si, Nb, and Ni alone or in a total amount of 36 mass % or more is precipitated at a grain boundary of an austenite matrix, and the low thermal expansion superalloy has a structure in which an intermetallic compound including a larger concentration of Ni, Al, Ti, and Nb than that of the alloy and having 50 nm or smaller of a diameter by an average value is precipitated in the austenite matrix.

2. The low thermal expansion superalloy according to claim 1, having a composition including, in terms of mass %, 0.05% or less of C, 0.2% to 0.7% of Si, 0.5% or less of Mn, 26% to 29% of Ni, more than 18% and 22% or less of Co, 0.3% to 0.6% of Al, 0.6% or more and less than 1.2% of Ti, 2.5% or more and less than 3.0% of Nb, 0.001% to 0.01% of B, 0.0005% to 0.01% of Mg, a remainder of Fe, and inevitable impurities, in which relationships of $Mg/S \geq 1$, $52.9\% \leq 1.235Ni+Co < 55.8\%$, 3.5% to 4.7% of Al+Ti+Nb, and 6% or less of the absolute value of the F value are satisfied, wherein the F value is calculated based on: F value=0.0014Ni+0.6Co−6.8Al+7.6Ti−5.3Nb−0.11Fe.

3. The low thermal expansion superalloy according to claim 1, further including 0.1% or more and less than 1.7% of Cr in terms of mass %.

4. The low thermal expansion superalloy according to claim 1, further including 0.4% to 1.6% of Cr in terms of mass %.

5. The low thermal expansion superalloy according to claim 1, wherein reduction of area in a room temperature tensile test in a solution treated state of the low thermal expansion superalloy is 50% or higher.

6. The low thermal expansion superalloy according to claim 1, wherein an average thermal expansion coefficient at 30° C. to 500° C. in an aging treated state is $8.1 \times 10^{-6}$/° C. or lower, tensile strength at room temperature is 780 MPa or higher, tensile strength at 550° C. is 600 MPa or higher, a parallel portion thereof ruptures in a combination smooth/notched creep test under a stress of 510 MPa at 650° C. and elongation after rupture is 10% or more, and in an oxidation test at 600° C. in the air for 100 hours, an oxide layer is not spalled and an oxidation weight gain is 1.3 mg/cm$^2$ or less.

7. A manufacturing method for a low thermal expansion superalloy having the composition of the low thermal expansion superalloy according to claim 1, the method comprising:

performing vacuum induction melting on the low thermal expansion superalloy to obtain an ingot;

performing hot plastic working once or more by using the ingot;

performing an solution treatment at 850° C. to 1080° C.;

performing an aging treatment, at least once, including holding at 580° C. to 700° C. for 8 to 100 hours;

causing precipitation of a granular intermetallic compound containing one or more elements of Si, Nb, and Ni alone or in a total amount of 36 mass % or more at a grain boundary of an austenite matrix; and causing precipitation of an intermetallic compound including a larger concentration of Ni, Al, Ti, and Nb than that of the alloy and having 50 nm or smaller of a diameter by an average value in the austenite matrix.

8. The manufacturing method for a low thermal expansion superalloy according to claim 7, further comprising:

performing electroslag remelting and/or vacuum arc remelting after the vacuum induction melting to manufacture an ingot.

* * * * *